US005676458A

United States Patent [19]

Shemitz et al.

[11] Patent Number: 5,676,458

[45] Date of Patent: Oct. 14, 1997

[54] LUMINAIRE

[75] Inventors: Sylvan R. Shemitz; David B. Miller; Gregory L. Moler, all of Woodbridge, Conn.

[73] Assignee: Sylvan R. Shemitz Designs, Inc., West Haven, Conn.

[21] Appl. No.: 623,108

[22] Filed: Mar. 28, 1996

[51] Int. Cl.[6] ..... F21V 21/30

[52] U.S. Cl. ..... 362/374; 362/269; 362/349; 362/372

[58] Field of Search ..... 362/217, 223, 362/269, 287, 297, 307, 310, 311, 370, 371, 372, 374, 375, 427, 349; D26/63, 76, 118

[56] References Cited

U.S. PATENT DOCUMENTS

| | | | |
|---|---|---|---|
| Re. 33,593 | 5/1991 | Herst et al. | 362/223 |
| D. 308,114 | 5/1990 | Shemitz | D26/85 |
| D. 308,260 | 5/1990 | Shemitz | D26/85 |
| D. 312,886 | 12/1990 | Brown | D26/63 |
| D. 349,173 | 7/1994 | Fellinger | D26/85 |
| D. 356,876 | 3/1995 | Waldmann | D26/107 |
| D. 360,049 | 7/1995 | Shemitz | D26/74 |
| D. 360,270 | 7/1995 | Shemitz | D26/74 |
| D. 362,314 | 9/1995 | Shemitz | D26/74 |
| D. 366,536 | 1/1996 | Shemitz | D26/88 |
| 4,164,784 | 8/1979 | Jaksich | 362/371 |
| 4,747,025 | 5/1988 | Barton | 362/147 |
| 4,796,169 | 1/1989 | Shemitz | 382/282 |

OTHER PUBLICATIONS

Elliptipar, Inc., Drawing No. 100/S/83/D/220, Aug. 3, 1983.

Elliptipar, Inc., Drawing No. 100/S/85/D-358, Jul. 18, 1985 and related photograph.

SPI Lighting, "Semi-Recessed Wall Wash Unit ECR SR/EDR SR 1 and 2", SPI Lighting, Inc., Catalog Insert p. 392-35 (1992).

Insight Lighting, "5 by 10 Semi Recessed", Insight Lighting 5x10 Taos Series drawing (date unknown).

Insight Lighting, "TAOS SR Interior Architectural Luminaires: Semi-Recessed/Biaxial Fluorescent" data sheet (1995).

Insight Lighting, "TAOS SR Interior Architectural Luminaires: Semi-Recessed/Compact Fluorescent" data sheet (1995).

Insight Lighting, "TAOS SR Interior Architectural Luminaires: Semi-Recessed/Incandescent & HQI" data sheet (1995).

*Primary Examiner*—Y My Quach

*Attorney, Agent, or Firm*—Fish & Neave; Jeffrey H. Ingerman

[57] ABSTRACT

A cylindrical luminaire is provided whose components align easily, for quicker assembly, despite the lack of intrinsic preferred relative orientation in circular components. Circular end plates affixed in a desired alignment to the end of an elongated reflector have slots to receive a baffle and notches for alignment of a part-cylindrical cover. The reflector, cover and baffle are thereby assembled in proper alignment.

20 Claims, 6 Drawing Sheets

12
3
68
15'
601
600
20
61
62
63
13
11
14
21
20
600
68
15
10
601
3

LUMINAIRE

BACKGROUND OF THE INVENTION

This invention relates to luminaires. More particularly, this invention relates to an elongated cylindrical luminaire having a construction that simplifies and shortens the assembly process.

Elongated luminaires, such as those used with fluorescent tubes or other elongated light sources, are well known. Such luminaires frequently have elongated reflectors in which the light sources are mounted for optimum utilization of the output of the light source. However, a reflector which gives the optimum light output for a particular application may not have an aesthetically pleasing external appearance for that application. Therefore, it is well known in such luminaires to conceal the reflector in a decorative housing.

For example, it is known to provide a luminaire in which the reflector is concealed in a part-cylindrical outer cover. That is, the outer cover is a cylindrical surface extending circumferentially less than 360°, as though it were the surface of a cylinder from which a sector had been removed. The ends of the cylinder are closed with circular end caps. In such a luminaire, the output opening of the reflector typically occupies only a portion of the opening in the cylinder, with the remainder of the opening covered by a baffle. Proper alignment of the reflector and the baffle with the opening is important. However, because the cylinder and the end caps are circular, having no inherently preferred relative orientation, proper assembly of such a luminaire may be difficult and time-consuming.

It would be desirable to be able to provide a cylindrical luminaire which can be easily and quickly assembled with all of its components in proper orientation.

SUMMARY OF THE INVENTION

It is an object of this invention to provide a cylindrical luminaire which can be easily and quickly assembled with all of its components in proper orientation.

In accordance with this invention, there is provided a luminaire with an elongated reflector. The reflector has first and second reflector ends, a reflector longitudinal axis extending between the first and second reflector ends, a length along the reflector longitudinal axis, a plurality of fastener receiving ports at each of the first and second reflector ends, a reflector opening through which light is emitted, and first and second reflector edges bounding the reflector opening.

An outer part-cylindrical cover is disposed about the elongated reflector. The cover has first and second cover ends, a cover longitudinal axis which is substantially parallel to the fixture longitudinal axis, a cover radius, and a cover length along the cover longitudinal axis which is greater than the reflector length, such that the first and second cover ends are beyond the first and second reflector ends, respectively.

The cover extends circumferentially less than 360°, thereby forming a longitudinally extended cover opening therein, with the reflector opening facing the cover opening. The cover opening is bounded by cover edges in a direction along the cover longitudinal axis, with the first cover edge being substantially adjacent one of the reflector edges. The cover has portions that are thickened radially inwardly toward the cover longitudinal axis at least adjacent the first and second cover ends.

A baffle extends in a first direction longitudinally from the first end to the second end, and in a second direction perpendicular to the first direction between the second cover edge and the second reflector edge. The baffle has first and second baffle ends adjacent the first and second cover ends.

First and second substantially circular end plates, each having a radius substantially equal to the cover radius, are located substantially adjacent the respective ones of the first and second ends. Each end plate has a plurality of reflector aligners corresponding to, and in alignment with, the plurality of fastener receiving ports, for fastening each end plate to a respective one of the first and second reflector ends through the plurality of fastener receiving ports. Each end plate also has a baffle aligner for receiving a respective one of the baffle ends, and first and second cover aligners for receiving the radially thickened portions of the cover edges.

First and second cylindrical end caps are provided. Each end cap has a substantially circular plate portion disposed parallel and adjacent to a respective one of the end plates and bounded by a cylindrical skirt that fits over the part-cylindrical cover. The substantially circular plate portion has a radius substantially equal to the cover radius.

The fasteners, the fastener holes, the fastener receiving ports, the cover aligners, the radially thickened portions, and the baffle aligners cooperate to maintain a desired alignment among said reflector, the baffle and the cover. Easy and rapid assembly of the luminaire, as well as maintenance of proper alignment of the components during handling, are thereby facilitated.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

The cylindrical luminaire according to the present invention includes alignment structures on the various parts from which it is assembled. Accordingly, even though many of the components are circular, they still have a preferred relative orientation. This facilitates assembly, resulting in a decrease in assembly time (and concomitantly in assembly cost), and also provides a more consistent, better aligned product.

Figure 1:
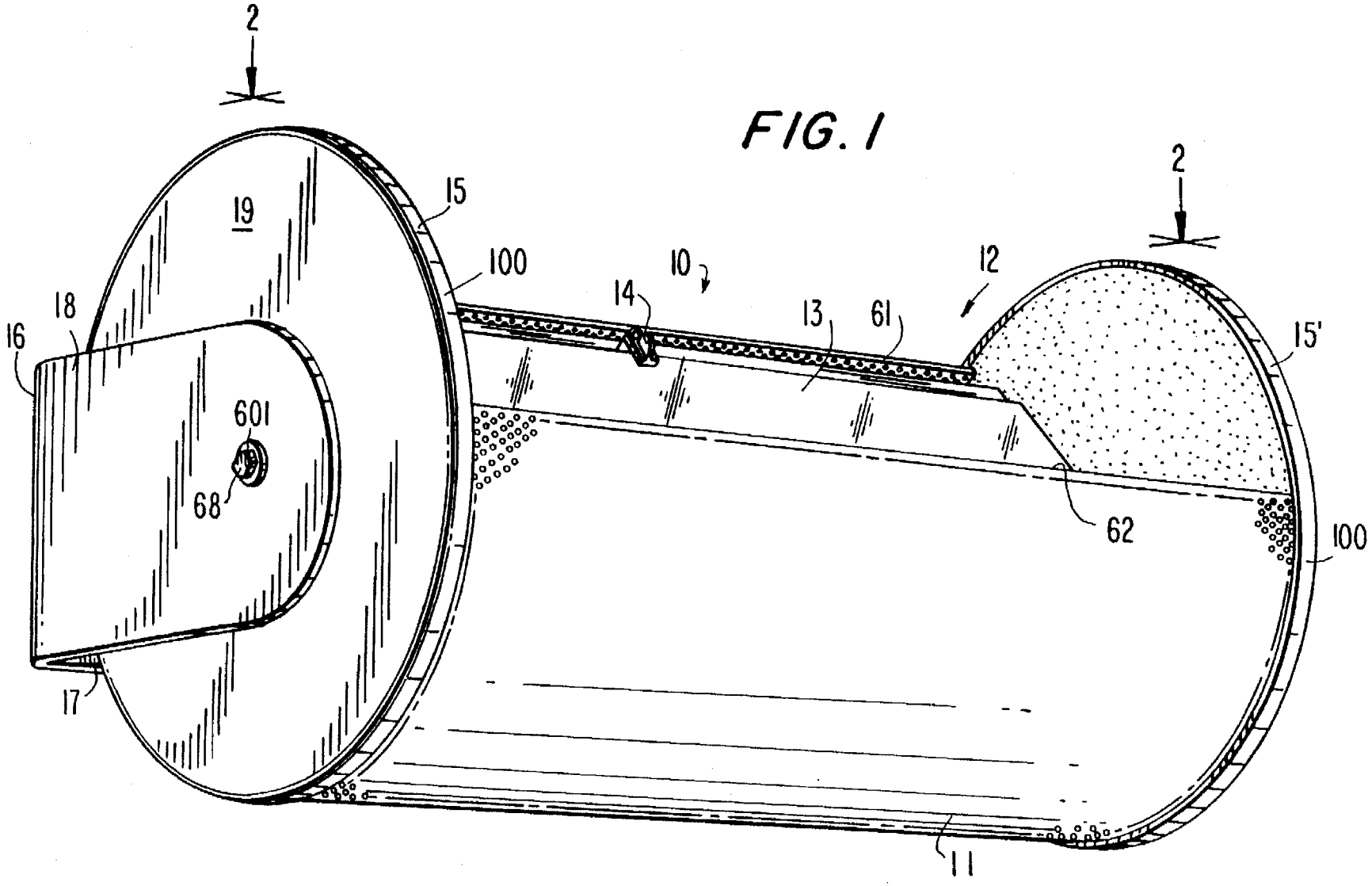
FIG. 1 is a perspective view of a preferred embodiment of a cylindrical luminaire according to the present invention.
Figure 2:
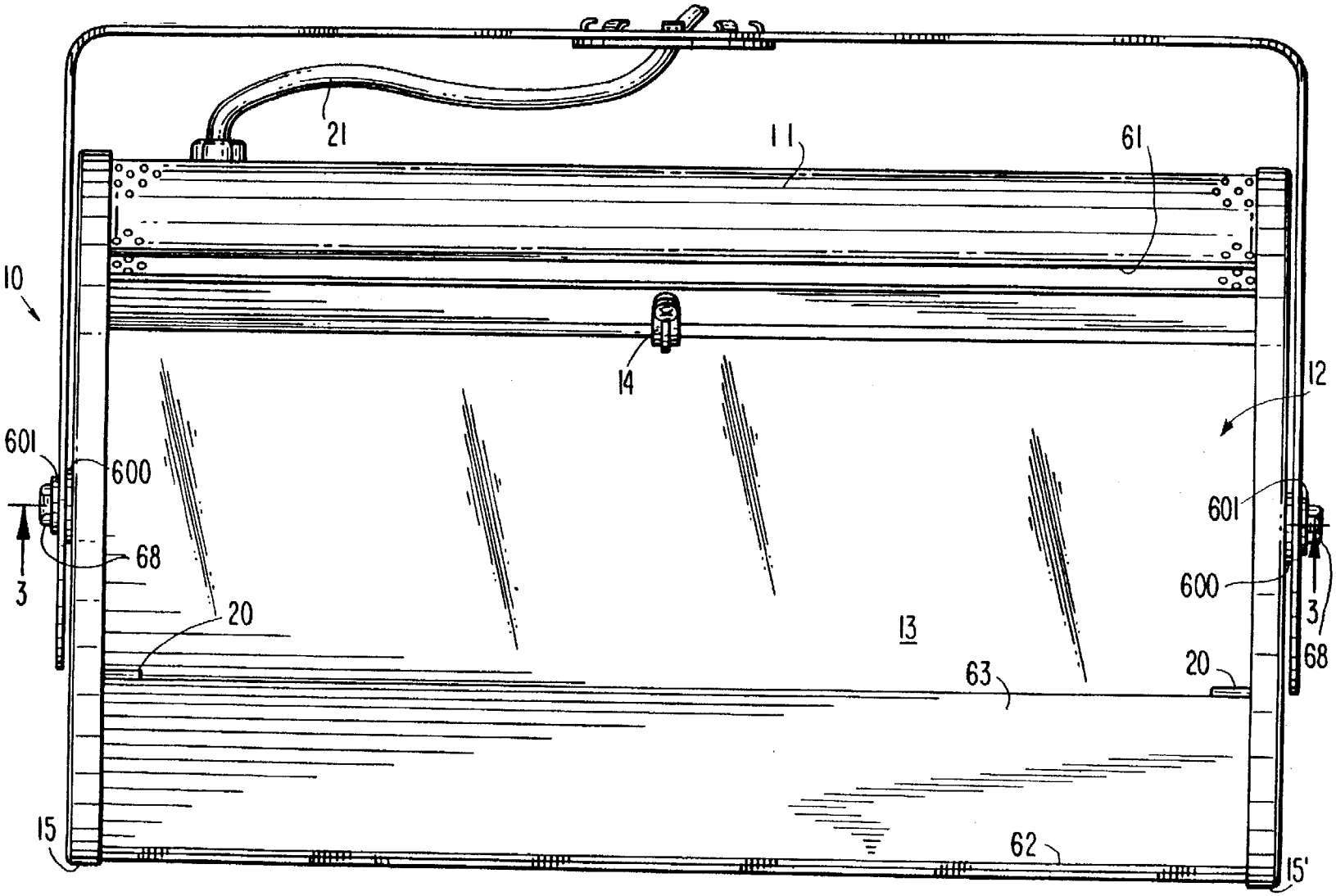
FIG. 2 is a plan view of the luminaire of FIG. 1, taken from line 2—2 of FIG. 1.
Figure 3:
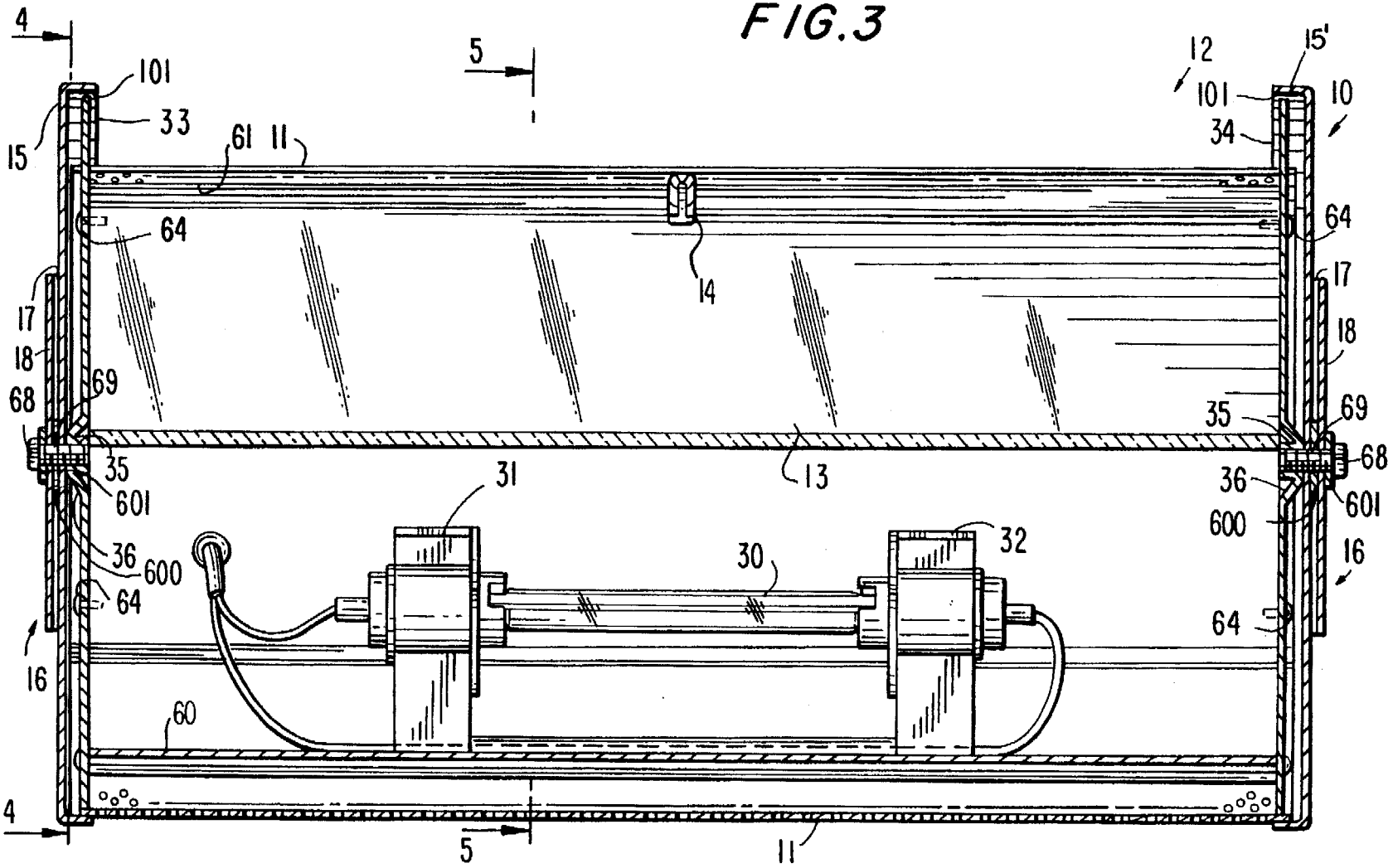
FIG. 3 is a longitudinal cross-sectional view of the luminaire of FIGS. 1 and 2, taken from line 3—3 of FIG. 2.
Figure 4:
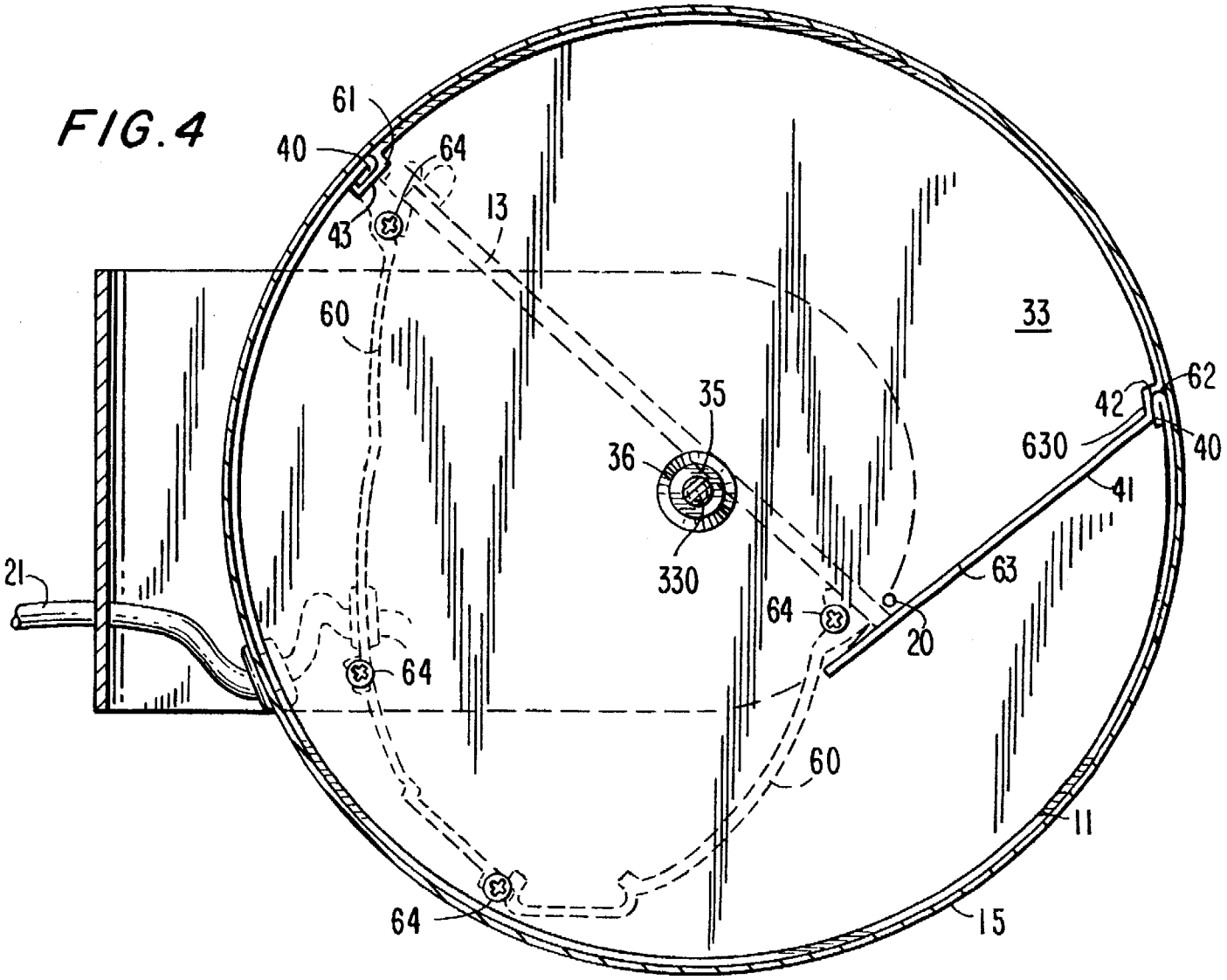
FIG. 4 is a radial cross-sectional view of the luminaire of FIGS. 1–3, taken from line 4—4 of FIG. 3.
Figure 5:
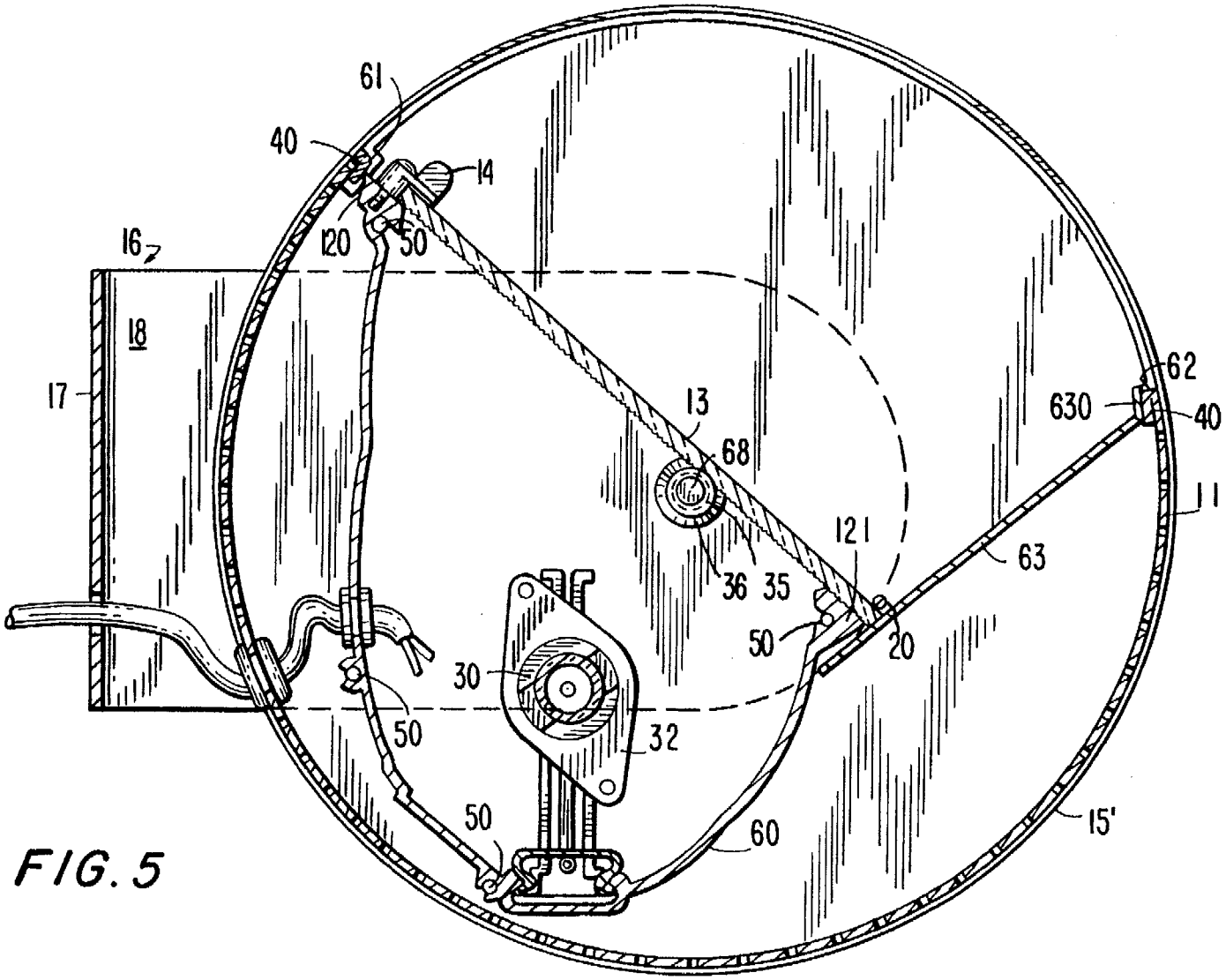
FIG. 5 is a radial cross-sectional view of the luminaire of FIGS. 1–4, taken from line 5—5 of FIG. 3.
Figure 6:
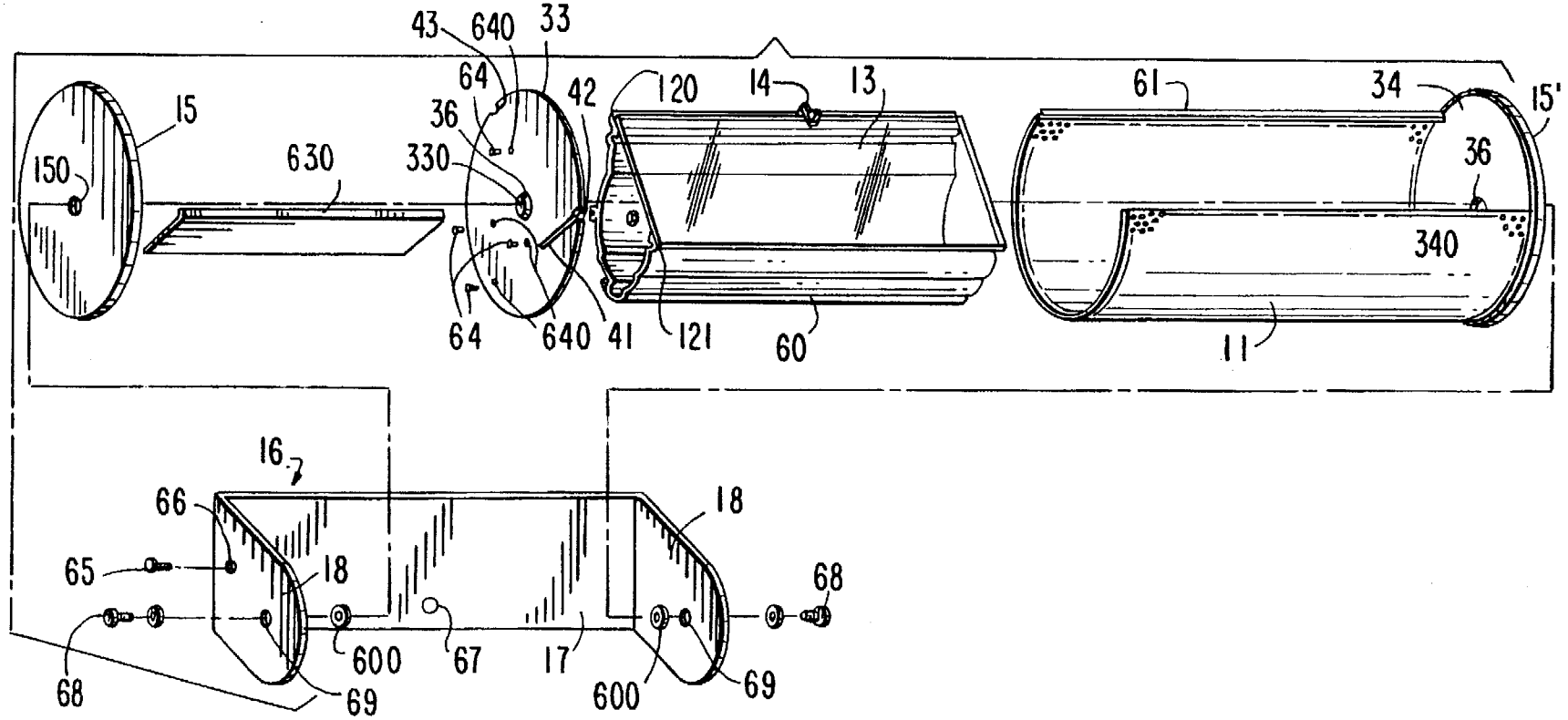
FIG. 6 is an exploded perspective view of the luminaire of FIGS. 1–5.

A preferred embodiment of a luminaire 10 according to the invention is shown in FIGS. 1–6.

Luminaire 10 is preferably substantially cylindrical, preferably having an outer part-cylindrical cover 11 surrounding an elongated reflector 60. A particularly preferred reflector is the ELLIPTIPAR® reflector available from the Elliptipar division of Sylvan R. Shemitz Designs, Inc., of West Haven, Conn. Reflector 60 preferably houses a light source 30, supported in reflector 60 by one or more lampholders 31, 32. Light source 30 is preferably a point or line source, but other light sources, including but not limited to tungsten-halogen lamps, linear fluorescent lamps, compact fluorescent lamps, or larger diameter luminous sources may be used.

Part-cylindrical outer cover 11 is preferably a surface such as would be obtained on the surface a cylindrical solid if a sector were removed from the cylindrical solid. Cover 11 thus extends circumferentially for less than 360°, leaving an opening 12 that reveals reflector 60 and light source 30. The longitudinal edges 61, 62 of cover 11 that bound opening 12 are preferably rolled over to form smooth edges, and preferably resulting in thickened portions 40. While in the preferred embodiment shown, cover 11 is perforated, it may also be solid or have any other desired configuration.

A portion of opening 12 preferably is filled by reflector 60, one edge 120 of which is preferably adjacent edge 61 of cover 11. The remainder of opening 12 is covered by a baffle 63, which preferably extends from edge 62 of cover 11 to the other edge 121 of reflector 60. In the embodiment shown, baffle 63 does not meet edge 121 of reflector 60 at the longitudinal axis of cover 11. Thus, even though the surface of cover 11 can be defined by a cylindrical solid from which a cylindrical sector has been removed, the solid portion actually missing from the cylinder whose surface defines cover 11 is not actually a sector. However, in other embodiments (not shown), it may be possible for edge 121 of reflector 60 to meet baffle 63 at or near the longitudinal axis, in which case the solid portion missing from the cylinder would be substantially a sector.

First and second end plates 33, 34 preferably are affixed to the longitudinal ends of reflector 60, preferably by screws 64 passing through holes 640 in end plate 33, 34 into fastener ports 50 in reflector 60. End plates 33, 34 and edges 120, 121 of reflector 60 together preferably form a substantially rectangular opening through which light exits reflector 60. That opening is preferably covered with a light transmissive plate or lens 13, which preferably is held in place by a releasable latch 14 preferably mounted on edge 120 of reflector 60, and by a respective pin 20, one of which extends longitudinally from each end plate 33, 34. Each pin 20 captures lens 13 against edge 121 of reflector 60 and against baffle 63. Other possible mountings can be used for lens 13, including a gasketed door with screw fasteners. Alternatively, depending on the type of light source used, lens 13 could be omitted.

The outer side of each end plate 33, 34 is preferably covered by an end cap 15, 15', which hides the fasteners and other elements (see below) affixed to or protruding from end plates 33, 34, forming a smooth, aesthetically pleasing outer surface. A bracket 16, preferably having a base 17 and a pair of substantially parallel arms 18, preferably is affixed to both ends of the cylinder formed by cover 11 and end caps 15, 15', and is used to mount luminaire 10 to a wall or other mounting surface. An electrical cable 21 connected to light source 30 exits through reflector 60 and cover 11 and preferably passes through a hole 67 in base 17 for connection to a power source (not shown) in the wall or other mounting surface.

Preferably, the cylindrical body of luminaire 10 is pivotable about its longitudinal axis relative to bracket 16, but is preferably restrained from pivoting once mounted by a set screw 65 passing through a hole 66 in one of arms 18 and tightened against end cap 15 after installation to function as a brake against pivoting. Hole 66 may be provided tapped, or set screw 65 could be self-tapping, in which case hole 66 becomes tapped as soon as set screw 65 is inserted.

End plates 33, 34 preferably provide alignment of reflector 60, cover 11 and baffle 63. As already described, end plates 33, 34 preferably are affixed to reflector 60 by screws 64 passing through holes 640 in end plates 33, 34 into fastener receiving ports 50 of reflector 60. The alignment of end plates 33, 34 with reflector 60 is thus substantially assured. The alignment of reflector 60 with baffle 63 is similarly assured by the provision in each of end plates 33, 34 of a respective slot 41 into which baffle 63 is inserted. A preferably upturned end 630 of baffle 63 preferably rests in a respective notch 42, communicating with slot 41, in each end plate 33, 34.

Notch 42 is preferably deep enough to accept not only upturned end 630 of baffle 63, but also thickened portion 40 of edge 62 of cover 11. A similar notch 43 preferably accepts thickened portion 40 of edge 61 of cover 11. The alignment of cover 11 relative to end plates 33, 34 is thereby also assured.

The cylindrical body is therefore easily assembled in proper alignment by affixing end plates 33, 34 to reflector 60, inserting baffle 63 into slots 41, and covering the assembly with cover 11, whose thickened portions 40 fit into notches 42, 43. Notches 42, 43, cooperating with thickened portions 40, align cover 11 relative to end plates 33, 34. Although thickened portions 40 are shown as being formed from rolled over edges of cover 11, any other type of protrusion may be provided. Similarly, instead of notches 42, 43, any other type of socket may be provided in or on end plate 33, 34.

Preferably, the radius of each end plate 33, 34 between notches 42, 43 where cover 11 rests is smaller than the radius of the remainder of end plate 33, 34 by the thickness of cover 11, so that the assembly of cover 11 onto end plates 33, 34 creates a substantially round structure. This allows end caps 15, 15' to be attached easily, covering screws 64 and the protruding ends of baffle 63.

End caps 15, 15' preferably are affixed to luminaire 11 by the bolts 68 (preferably hex-head bolts) that attach the cylindrical body to bracket 16. Thus, each bolt 68 preferably passes through a hole 69 in respective arm 18, then through a hole 150 in end cap 15, 15' and a hole 330 in end plate 33, 34, where it mates with a nut 35 that preferably is formed integrally with end plate 33, 34. A washer 600 preferably is provided between end cap 15, 15' and arm 18, and a washer 601 preferably is provided between arm 18 and the head of bolt 60.

Each end cap 15, 15' includes a substantially circular plate portion 19 and a substantially cylindrical skirt 100. End plates 33, 34 are preferably a darker color, most preferably black, than the remainder of luminaire 11, in order to produce a desired lighting effect. In the portion of luminaire 10 outside the angular extent of cover 11, the inside wall portion 101 of each cylindrical skirt 100 would be visible against the darker end plate 33, 34 if end plate 33, 34 were to lie directly against plate portion 19 of end cap 15, 15'. Therefore, each end plate 33, 34 preferably has a central boss 36 which spaces the surface of end plate 33, 34 sufficiently far from plate portion 19 to at least substantially prevent interior wall portion 101 of cylindrical skirt 100 from being visible. Boss 36 also provides a space in which nut 35 can be provided, without protruding into the interior space of reflector 60. Of course, any other suitable spacer can be provided in place of boss 36.

Thus it is seen that a cylindrical luminaire which can be easily and quickly assembled with all of its components in proper orientation has been provided. One skilled in the art will appreciate that the present invention can be practiced by other than the described embodiments, which are presented for purposes of illustration and not of limitation, and the present invention is limited only by the claims which follow.

What is claimed is:

1. A luminaire comprising:

(a) an elongated reflector having:

(i) first and second reflector ends, (ii) a reflector longitudinal axis extending between said first and second reflector ends, (iii) a reflector length along said reflector longitudinal axis, (iv) a plurality of fastener receiving ports at each of said first and second reflector ends, (v) a reflector opening through which light is emitted, and (vi) first and second reflector edges bounding said reflector opening; and (b) an outer part-cylindrical cover disposed about said elongated reflector, said cover having:

(i) first and second cover ends, (ii) a cover longitudinal axis, said cover longitudinal axis being substantially parallel to said reflector longitudinal axis, (iii) a cover radius, and (iv) a cover length along said cover longitudinal axis, said cover length being greater than said reflector length, such that said first and second cover ends extend beyond said first and second reflector ends, respectively, wherein:

said cover extends circumferentially less than 360°, thereby forming a longitudinally extended cover opening therein, said reflector opening facing said cover opening, said cover opening being bounded by cover edges in a direction along said cover longitudinal axis, said first cover edge being substantially adjacent one of said reflector edges, said cover having portions thickened radially inwardly toward said cover longitudinal axis at least adjacent said first and second cover ends respectively; said luminaire further comprising:

(c) a baffle extending in a first direction longitudinally from said first cover end to said second cover end, said baffle extending in a second direction perpendicular to said first direction between said second cover edge and said second reflector edge, said baffle having first and second baffle ends adjacent said first and second cover ends;

(d) first and second substantially circular end plates, each of said first and second end plates having a radius substantially equal to said cover radius and being substantially adjacent a respective one of said first and second reflector ends, each said end plate having:

(i) a plurality of reflector aligners corresponding to, and in alignment with, said plurality of fastener receiving ports, fastening each of said first and second end plates to a respective one of said first and second ends of said reflector through said plurality of fastener receiving ports, (ii) a baffle aligner receiving a respective one of said baffle ends, and (iii) first and second cover aligners receiving said radially thickened portions of said cover; and (e) first and second cylindrical end caps, each of said end caps having a substantially circular plate portion disposed parallel and adjacent to a respective one of said end plates and being bounded by a cylindrical skirt that fits over said part-cylindrical cover, said substantially circular plate portion having a radius substantially equal to said cover radius; whereby:

said reflector aligners, said fastener receiving ports, said cover aligners, said radially thickened portions, and said baffle aligners cooperate to maintain a desired alignment among said reflector, said baffle and said cover.

2. The luminaire of claim 1 further comprising a light transmissive panel extending from said first reflector edge to said second reflector edge.

3. The luminaire of claim 1 wherein said reflector, said cover, said end plates and said end caps form a body having a body longitudinal axis corresponding to said cover longitudinal axis, said luminaire further comprising a bracket for mounting said body on a surface.

4. The luminaire of claim 3 wherein said bracket attaches to said body along said body longitudinal axis.

5. The luminaire of claim 4 wherein:

said bracket has a base for attaching to a surface and two arms, one for attaching to said body at each said end cap; and each of said arms, said end caps and said end plates has a mounting hole therein along said body longitudinal axis; said luminaire further comprising:

first and second bolts, and corresponding first and second nuts, each of said bolts and its corresponding nut fastening together a respective arm, end cap and end plate at a respective end of said body, through a respective one of said mounting holes.

6. The luminaire of claim 5 wherein each of said first and second nuts is formed integrally with a respective one of said first and second end plates at said mounting hole.

7. The luminaire of claim 5 wherein:

said body is rotatable relative to said bracket; said luminaire further comprising:

a brake for preventing relative rotation of said body and said bracket.

8. The luminaire of claim 7 wherein:

one of said arms has a tapped hole therein; and said brake comprises a set screw received in said tapped hole.

9. The luminaire of claim 5 wherein each said end plate has a spacer for maintaining desired spacing between said end plate and said end cap.

10. The luminaire of claim 9 wherein said spacer comprises a boss.

11. The luminaire of claim 10 wherein:

said boss is formed at said mounting hole; and each of said first and second nuts is formed integrally with a respective one of said first and second end plates in said boss.

12. The luminaire of claim 1 wherein each of said end plate has a spacer for maintaining desired spacing between said end plate and said end cap.

13. The luminaire of claim 12 wherein said spacer comprises a boss.

14. The luminaire of claim 1 wherein said radially thickened portions of said cover comprise radially thickened cover edges.

15. The luminaire of claim 14 wherein each of said radially thickened cover edges comprises a folded-over edge of said cover.

16. The luminaire of claim 1 wherein each of said end plates has a slot therein having dimensions for receiving one of said baffle ends, said baffle aligner comprising said slot.

17. The luminaire of claim 16 wherein:

each of said end plates has a circumference with first and second notches therein;

each of said cover aligners comprises one of said notches; and said first notch is deeper than said second notch, said first notch communicating with said slot and receiving a portion of said baffle.

18. The luminaire of claim 1 wherein each of said end plates has a circumference with two notches therein, each of said cover aligners comprising one of said notches.

19. The luminaire of claim 1 wherein:

each of said end plates has a plurality of holes therein corresponding to and in alignment with said fastener receiving ports; and said reflector aligners comprise a plurality of fasteners extending through said holes in said end plates.

20. The luminaire of claim 19 wherein each of said plurality of fasteners is a screw.

* * * * *

UNITED STATES PATENT AND TRADEMARK OFFICE

CERTIFICATE OF CORRECTION

PATENT NO. : 5,676,458

DATED : October 14, 1997

INVENTOR(S) : Sylvan R. Shemitz et al.

It is certified that error appears in the above-identified patent and that said Letters Patent is hereby corrected as shown below:

Column 3, line 7, after "surface" should be inserted -- of --.

Column 4, line 50, "60." should be -- 68. --.

Signed and Sealed this

Eleventh Day of July, 2000

*Attest:*

Q. TODD DICKINSON

*Attesting Officer*

*Director of Patents and Trademarks*